US012303767B2

(12) United States Patent
Clark et al.

(10) Patent No.: US 12,303,767 B2
(45) Date of Patent: May 20, 2025

(54) HOCKEY PANTS WITH FLOATING ABDOMINAL PROTECTION

(71) Applicant: INA INTERNATIONAL LTD., Calgary (CA)

(72) Inventors: Stan Clark, Calgary (CA); Nicole Wiart, Toronto (CA); Eric Lemieux, Saint-Sauveur (CA); Dan Rich, Calgary (CA)

(73) Assignee: INA INTERNATIONAL LTD., Calgary (CA)

( * ) Notice: Subject to any disclaimer, the term of this patent is extended or adjusted under 35 U.S.C. 154(b) by 6 days.

(21) Appl. No.: 18/007,365

(22) PCT Filed: Aug. 4, 2021

(86) PCT No.: PCT/CA2021/051084
§ 371 (c)(1),
(2) Date: Jan. 30, 2023

(87) PCT Pub. No.: WO2023/010199
PCT Pub. Date: Feb. 9, 2023

(65) Prior Publication Data

US 2024/0252909 A1 Aug. 1, 2024

(51) Int. Cl.

| | |
|---|---|
| ***A41D 13/05*** | (2006.01) |
| ***A63B 71/12*** | (2006.01) |
| *A63B 102/24* | (2015.01) |

(52) U.S. Cl.
CPC .. *A63B 71/1225* (2013.01); *A63B 2071/1208* (2013.01); *A63B 71/1216* (2013.01);
(Continued)

(58) Field of Classification Search
CPC ... A63B 71/1225; A41D 1/06; A41D 13/0568
(Continued)

(56) References Cited

U.S. PATENT DOCUMENTS

| | | | |
|---|---|---|---|
| 3,484,868 | A | 12/1969 | Davenport |
| 5,471,680 | A | 12/1995 | Vesterinen |

(Continued)

FOREIGN PATENT DOCUMENTS

| | | |
|---|---|---|
| CA | 2563855 | 4/2007 |
| CA | 2876433 | 6/2013 |
| CN | 111869944 A | 11/2020 |

OTHER PUBLICATIONS

International Search Report issued in co-pending International Application No. PCT/CA2021/051084 on Apr. 27, 2022.

(Continued)

*Primary Examiner* — Tajash D Patel
(74) *Attorney, Agent, or Firm* — Whiteford, Taylor & Preston, LLP; Gregory M. Stone

(57) ABSTRACT

Hockey pants having a floating pad for protecting the abdominals are provided. The pad may be connected indirectly to the hockey pants by means of one or more flexible bands which together comprise a belt connected to the lateral edges of the pad. The pad is also positionable at various heights on the front of the abdominals depending on the body type and needs of the wearer. This configuration allows for the wearer to customize the placement and fit of the abdominal pad, and also to gain protective benefits from the abdominal pad while not being constrained by obtrusive padding at the waist.

15 Claims, 12 Drawing Sheets

(52) U.S. Cl.
CPC ... *A63B 2071/1233* (2013.01); *A63B 2102/24* (2015.10); *A63B 2209/10* (2013.01)

(58) Field of Classification Search
USPC ..... 2/464
See application file for complete search history.

(56) References Cited

U.S. PATENT DOCUMENTS 5,966,739 A 10/1999 Wagner
6,637,036 B2 * 10/2003 Beland ..... A41D 1/08 2/467
6,745,406 B2 * 6/2004 Ruane ..... A41D 13/0506 2/23
6,751,804 B1 * 6/2004 Warner ..... A41D 13/065 2/23
6,804,832 B2 * 10/2004 Beland ..... A41D 13/0153 2/227
7,219,372 B2 * 5/2007 Frieler ..... A41D 13/065 2/23
7,716,755 B1 5/2010 Wiens
8,316,468 B2 * 11/2012 Skottheim ..... A41D 13/0506 2/227
8,505,122 B1 * 8/2013 Green ..... A41D 13/0156 2/463
12,193,529 B2 * 1/2025 Brown ..... A41D 13/0512
2002/0178483 A1 * 12/2002 Beland ..... A63B 71/1225 2/22
2007/0234467 A1 10/2007 Leach
2016/0174627 A1 * 6/2016 Martel ..... A41D 31/185 2/235
2019/0223529 A1 * 7/2019 Park ..... A41B 1/08

OTHER PUBLICATIONS

Office Action issued in co-pending Canadian Application No. 3,186,326 on May 9, 2024.
Communication of Acceptance issued in co-pending Finnish Application No. 20226172 on Jul. 9, 2024.

* cited by examiner

HOCKEY PANTS WITH FLOATING ABDOMINAL PROTECTION

FIELD OF THE INVENTION

The present invention relates generally to the field of protective apparel for sports such as hockey, and more particularly to protective pants for ice hockey players with an integrated pad to provide impact protection to the abdominal region.

BACKGROUND OF THE INVENTION

This invention relates to protective hockey pants having an integrated abdominal pad which has been configured to protect the wearer while allowing for flexibility of movement and positioning of the torso. The abdominal pad is mounted on a belt at a location generally at or above the waist region of the player. The belt may incorporate elasticized portions on either side of the protective abdominal pad so that the pad will stay in place to protect the player in a number of bodily positions both during active play and downtime on the bench.

Players of high-impact sports such as hockey have a need for padded protective garments. In addition to protection for the head, shoulders, chest, and hands, hockey pants are a crucial part of the gear worn by a typical hockey player. Most hockey pants are garments that extend from the waist area to the knees, and may include padding in the areas of the groin, hips, tailbone, and kidneys. The padding is most commonly constructed as an inner protective layer of the pants, and covered with a thin shell overlay.

In addition to protecting vulnerable areas of the body, hockey pants should be configured to interfere as little as possible with the hockey player's movement and body positioning. Hockey players move between a number of straight and angular configurations on the ice during forward and backward skating, attacking and defending, and shooting the puck, in which the torso and knees may be bent at various angles and heights. In addition, hockey players spend significant time off the ice in a sitting position on the bench between active shifts, requiring them to repeatedly leave and then return to the ice surface by climbing over boards which surround the rink. Protective garments worn by hockey players should be comfortable throughout the whole range of body positions of the player, and the padded areas should not shift during movement, so that they serve to protect the body region for which they are configured.

A region of the body that has not been adequately protected by existing hockey protective gear is the abdominals, particularly the front center region of the abdominals (the rectus abdominus). Hockey pants generally do not have padding in this region. This is likely because typical hockey players are bent forward while playing, and bulky abdominal padding incorporated into the pants could overly interfere with flexibility of the torso. As well, given the hockey player's typically crouched position while playing, it was likely assumed that the abdominal area is less vulnerable to impact from a hockey stick, puck or collision with another player. Therefore, other developers of hockey pants have typically focused on protection for other vulnerable areas such as the hips, tailbone, and kidneys. However, the abdominals are an area of the player's body that would still benefit from having padding to reduce the chances of injury.

In addition, it would be beneficial to have some ability to customize the position of the abdominal padding for different sizes and shapes of players. Hockey is a popular amateur sport so there are players with a number of different body types and fitness levels who are engaging in hockey. It would be particularly beneficial for abdominal padding to be positionable over a variety of shapes of torsos, from very fit or narrow torsos to those of a wider girth or those incorporating greater bulk in the waist region. For example, some recreational hockey players may have protruding bellies which are not well protected by existing hockey pants. Players who are pregnant may desire greater abdominal protection during hockey games.

Therefore, there is a need for protective gear for hockey players that provides protection for the abdominals. Such gear should be convenient to wear, customizable to different body types, and should not interfere with movement or body positioning of the player.

SUMMARY OF THE INVENTION

These needs are addressed by the hockey pants of the invention which include a floating pad for protecting the abdominals. The pad may be connected indirectly to the hockey pants themselves by means of one or more flexible bands which together comprise a belt connected to the outer lateral edges of the pad. The pad is also positionable at various heights depending on the body type of the wearer. This configuration allows for the wearer to customize the placement and fit of the abdominal pad, and also to gain protective benefits from the abdominal pad while not being constrained by obtrusive and inflexible padding at the waist, which is the inner junction point on the torso where a player is most likely to be in a bent or crouched position during active play or while sitting on the bench.

As embodied and broadly described below, the present invention provides hockey pants with attached straps forming a belt, with said belt being positioned at or above the waist. The strap material may have flexibility so that it can stretch as needed during wear. An abdominal pad may be reversibly attached to the straps, such that the pad can be moved upwards or downwards into a position optimal for the wearer. The pad may be attached by hook and loop closures such as by opposing strips of VELCRO, to the strap material or belt so that its height on the torso may be adjusted as needed. Other ways to allow for such customization of height may be provided by other affixing means, such as rows of buttons or snaps.

In one aspect, the hockey pants, having a front, back, and two legs, may be full length with the pant legs extending down to the ankles, or half-length with the pant legs reaching down to or above the knees, or any length between. The pants may have padding in addition to the floating abdominal pad described above. In particular, the pants may incorporate padding for the back, tailbone, kidneys, hips, and/or groin, which together forms a padded girdle that provides protection for the player's sides, back and groin.

In a further aspect, the straps forming the belt attached to the abdominal pad may be flexible and may comprise a belt which is configured to extend circumferentially around the waist of the wearer, being attached along part or all of its bottom edge to the top periphery of the pants, and being connected at the front to the abdominal pad described above. The belt itself may also incorporate padding for the tailbone, back or kidneys.

In a still further aspect, the hockey pants may feature a first belt attached to the abdominal pad which primarily functions to hold the abdominal pad itself, as well as a second, separate belt on the hockey pants which is located lower on the pants. This second belt may perform the more traditional function of holding the pants in place around the waist of the player.

In yet a further aspect, the strap attached to the abdominal pad may not form a full belt, but rather consist of two distinct straps that attach on their ends to the pants, and attach on their other ends to the abdominal pad. Such straps may be of fixed length and directly attached to the pants, or may be of variable length and be attached by means which may be adjusted, such as VELCRO, length-adjustable buckles with or without rows of holes defining positions for the buckle, or rows of snap buttons. Many configurations for adjusting and securing a garment using straps are known in the art and may be substituted by skilled persons.

BRIEF DESCRIPTION OF THE DRAWINGS

The present invention will now be better understood with reference to the description and to the accompanying drawings in which.

In these figures, preferred embodiments of the invention are illustrated by way of examples. It is to be expressly understood that the description and drawings are only for the purpose of illustration and are an aid for understanding. They are not intended to define the limits of the invention. It should be understood that the drawings are not necessarily to scale, and in certain instances details may have been omitted that are not necessary for an understanding of embodiments of the present invention.

DETAILED DESCRIPTION OF THE PREFERRED EMBODIMENTS

As used in the following description, terms such as 'horizontal", "vertical", "left", "right", "upper", "lower" and similar terms refer to the orientation of the structures as illustrated.

Figure 1:
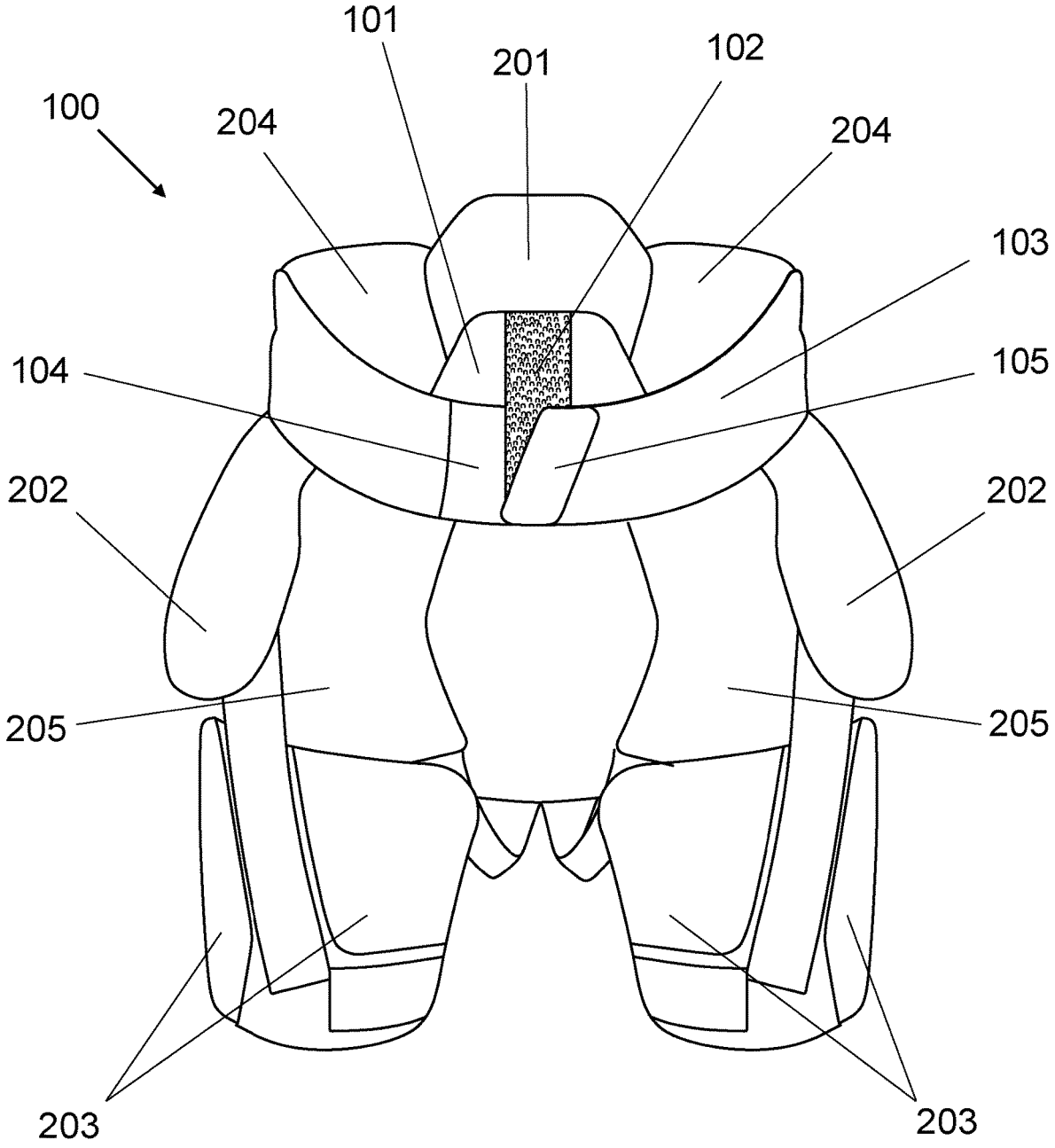
FIG. 1 is a front view of a preferred embodiment of the hockey pants including an abdominal pad attached to strapping, this embodiment showing the inner layers of the pants.

Turning now to the figures, FIG. 1 shows a preferred embodiment of a front view of the hockey pants 100 of the invention. In this figure, the outer shell of the hockey pants has been removed to better show the structure of the pants and attachment for the abdominal pad 101. In this embodiment, VELCRO surfaces are used, which incorporate "hook" surfaces which reversibly attach by pressure to opposing complementary "loop" surfaces. The abdominal pad 101 has padding on its interior side (not visible in this view) and is shown incorporating adjustment surface 102 comprising a hook VELCRO surface, in this case vertically oriented on the pad, which may attach to an opposing loop VELCRO surface.

Waist strap 103 in this embodiment constitutes a single band having a first end and a second end, being configured to encircle the waist. Waist strap 103 is cut away in part in this figure to better reveal abdominal pad 101. In this embodiment, waist strap 103 incorporates on a first end a buckle portion 105, which also has on its underside a patch of hook VELCRO. On a second end 104 of waist strap 103 is a loop VELCRO surface which extends around the whole of second end 104, to cover both its front surface which can be seen in this view, and its back surface which is not visible from this perspective. The user may tighten waist strap 103 by pulling first end 105 over second end 104 so that the opposing VELCRO surfaces may join to form a reversible bond. The abdominal pad 101 having a hook VELCRO surface also attaches to the inner loop VELCRO surface of waist band second end 104. In this way, the waist band 103 may be secured around the waist of the wearer, and the abdominal pad 101 may also be positioned on waist band 103 to block impacts to the abdominals of the wearer. In particular, abdominal pad 101 is configured to protect the front central abdominals, i.e. the region overlying the rectus abdominus.

In this embodiment, because the adjustment surface 102 of abdominal pad 101 is oriented as a vertical strip, the wearer may position the abdominal pad 101 at a range of heights along the front of the abdomen.

Waist band 103 may be constructed in whole or in part of an elasticized fabric. Abdominal pad 101 on its inner padded surface may be covered with a fabric that is comfortable when worn against the body, but which incorporates some friction so that the pad will not tend to slide against the skin or any other inner clothing layers worn by the player. An example of a suitable material which may be manufactured to incorporate sufficient friction is brushed polyester, particularly a wicking brushed polyester which will be less likely to absorb and retain moisture. Many other options for similar fabrics are available to the skilled person.

The flexibility of the waist band 103 combined with the friction generated by the abdominal pad 101 results in a close fit for the abdominal pad 101, which will tend to stay in position over the abdominals despite the wearer taking on a variety of bent, crouching, sitting or standing positions during active play or during downtime. In this manner, the wearer remains well-protected in the abdominal region throughout the game.

Hockey pants 100 also incorporate padding within a spine protector 201, hip protectors 202, thigh protectors 203, kidney protectors 204, and glute protectors 205. Spine protector 201 and kidney protectors 204 may form part of waist band 103, or may comprise separate segments, or may comprise extensions of the glute protectors 205. The padding may be provided by sponge foam, low or high density polypropylene foam, or similar materials. For hockey pants, sponge foam having a thickness of 7.5-10 mm works well, but other thicknesses may also be chosen depending on the preference of the player. The padding may be contained within any suitable fabric, most preferably a wicking fabric, and optionally a stretchable or compression material, such as fabrics containing spandex fibres or LYCRA, if it is desired to provide a snug fit.

In addition, to provide additional structure to protruding parts of the hockey pants that are particularly subject to wear and deformation such as the spine protector 201 and kidney protectors 204, it may be preferred to include in addition to the foam inserts, an internal frame made of molded polyethylene, another thermosetting plastic, or a similar material. Such an internal frame provides more structure to the part, and protects the inner padding from becoming laterally compressed, bent, or floppy over time.

Figure 2:
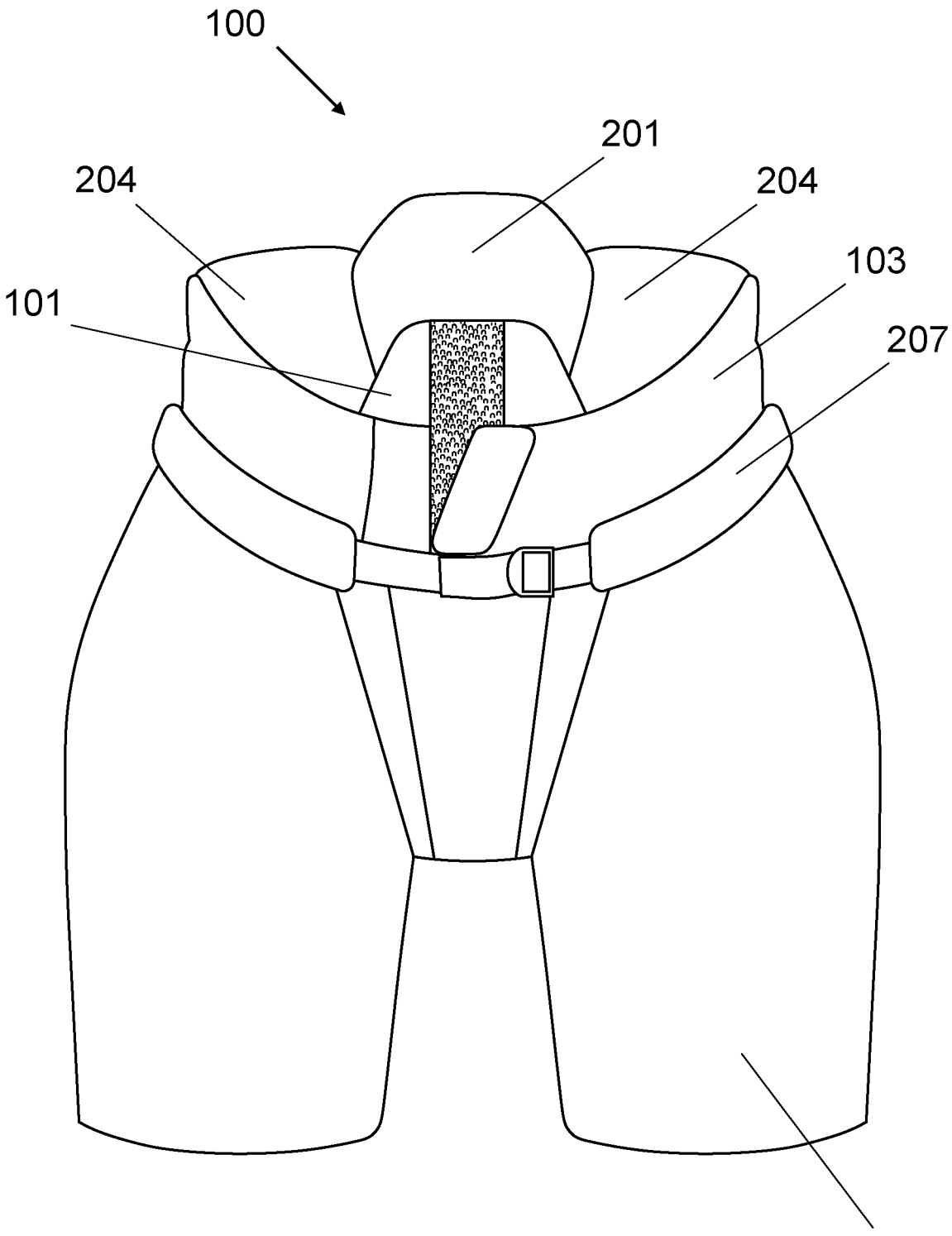
FIG. 2 is a front view of the preferred embodiment of FIG. 1, but including the outer shell covering much of the padding as well as a lower belt.

FIG. 2 shows the hockey pants 100 of FIG. 1 but includes an outer covering 206, which may be added to provide a housing for the multiple pieces incorporating padding as seen in FIG. 1. Outer covering 206 may be made of nylon, GORE-TEX, or a similar non-absorbent, water-resistant, waterproof, protective material, which may be a natural or synthetic material. Outer covering 206 may also be removable and interchangeable if it is desired to provide the player the option of different colours for outer covering 206, such as if the player wishes to wear different colours for different team uniforms, or if the player wishes to wash outer covering 206 separately from the inner components of hockey pants 100. Many options are available for providing outer covering 206 with the means to be removed and re-installed as needed, such as VELCRO strips, buttons, or snaps.

Also visible in FIG. 2 is cinching belt 207. Cinching belt 207 serves to keep hockey pants 100 secured about the waist of the player. Notably, in this embodiment, due to the presence of cinching belt 207, waist band 103 is not required to perform the function of keeping the pants themselves in place. Rather, as described previously, waist band 103 primarily serves to hold abdominal pad 101 in place above the abdominals. Waist band 103 may also incorporate the additional protective components mentioned previously such as spine protector 201 and kidney protectors 204. While the embodiment shown in FIG. 2 includes cinching belt 207, it is to be expressly understood that a separate cinching belt is not essential, as will be seen in other embodiments below of hockey pants 100. Rather, waist band 103 may also be configured to perform both the functions of holding abdominal pad 101 and cinching about the waist.

Figure 3:
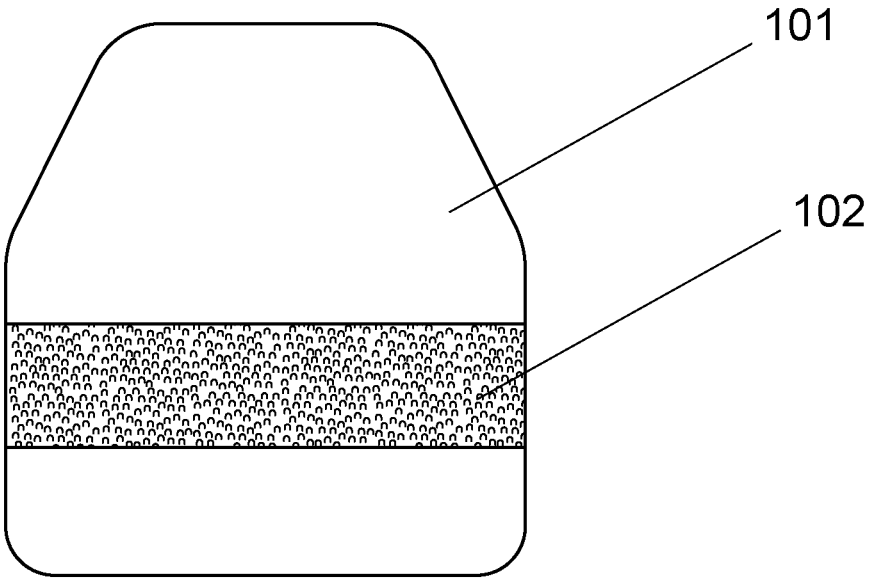
FIG. 3 is a front view of an embodiment of the abdominal pad.

FIG. 3 is an isolated view of an embodiment of abdominal pad 101. In this case, abdominal pad 101 may be attached to waist band 103 by adjustment surface 102 oriented horizontally. As shown, the range of heights at which abdominal pad 101 could be installed along the front of the abdomen would be more limited with the use of this embodiment, but due to the width of adjustment surface 102, a fair range of heights for installation may still be provided. An advantage of horizontally orienting adjustment surface 102 is that there may be greater surface area for contact of adjustment surface 102, shown here as a hook-VELCRO surface, with its opposing loop VELCRO surface on the underside of the waist band 103 by means of its second end 104. This configuration may increase the security of the connection.

Figure 4:
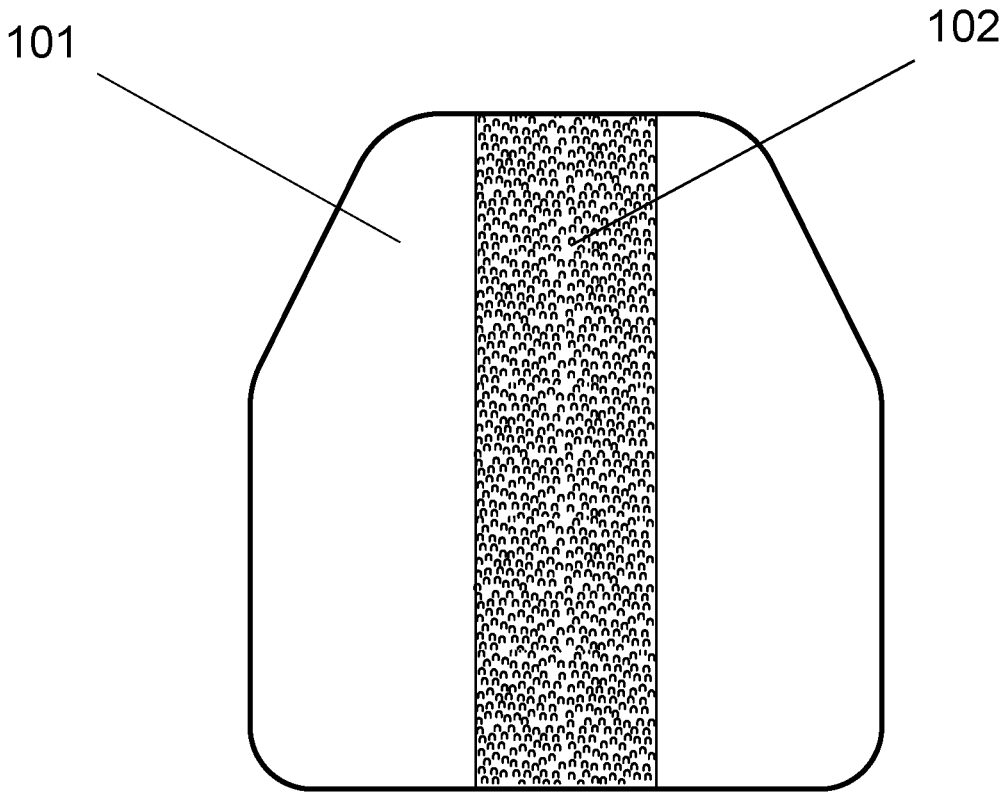
FIG. 4 is a front view of an alternate embodiment of the abdominal pad.

FIG. 4 is an isolated view of a further embodiment of abdominal pad 101. In this embodiment, adjustment surface 102 is oriented vertically on abdominal pad 101 so as to provide a greater range of heights along the front of the abdomen at which abdominal pad 101 may be installed.

Figure 5:
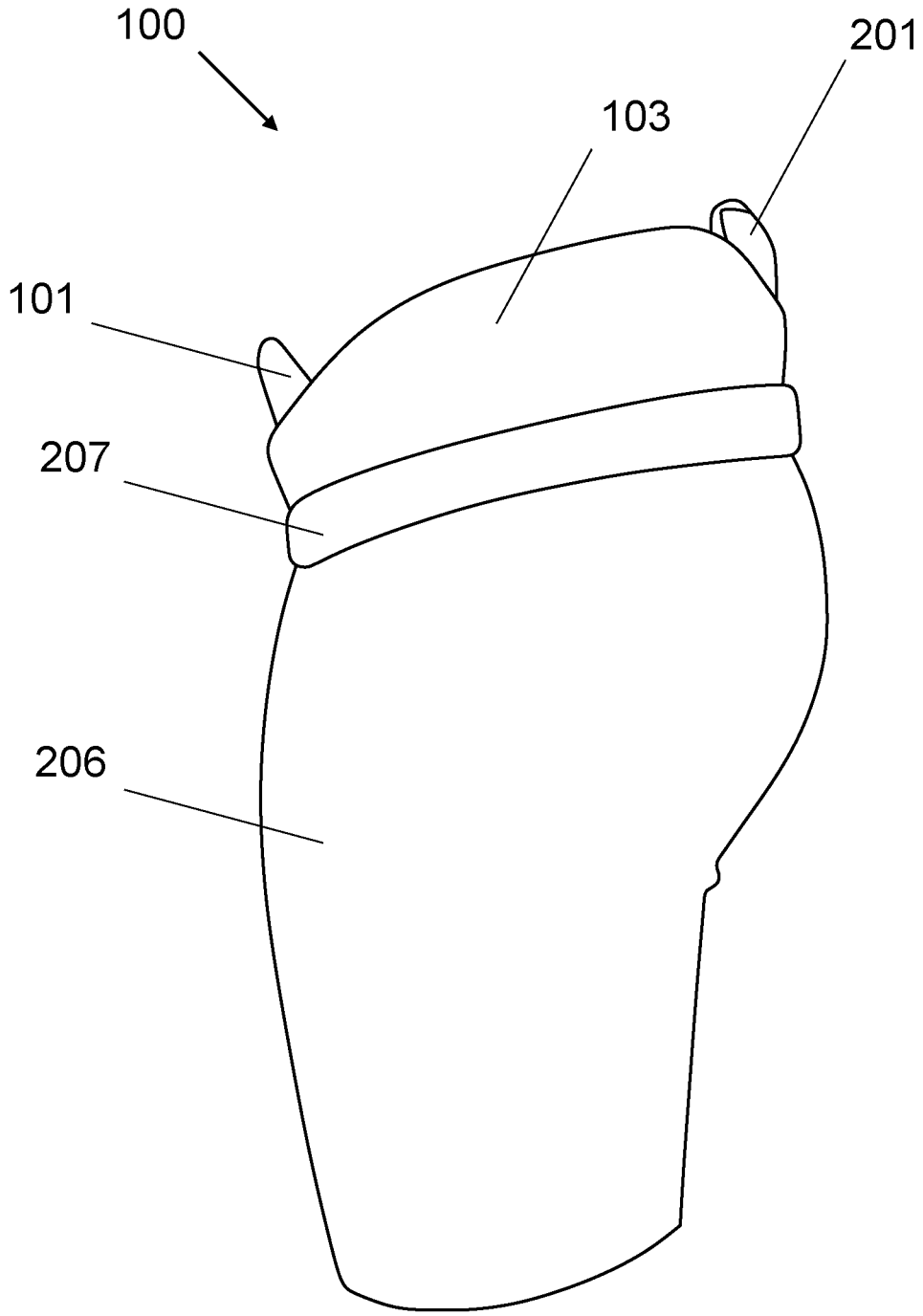
FIG. 5 is a side view of the pants of FIG. 2.

FIG. 5 shows a side view of hockey pants 100 of FIG. 2. In this embodiment, it can be seen that waist band 103 extends around across the back of hockey pants 100, and does not feature separately viewable kidney protectors 204 as seen in FIG. 1 and FIG. 2. In this embodiment, waist band 103 may integrally incorporate padding for the kidney region.

It can also be seen that cinching belt 207 is configured on hockey pants 100 to fall naturally at the narrowest portion of the waist, thus being well-positioned to hold hockey pants 100 to the body.

Figure 6:
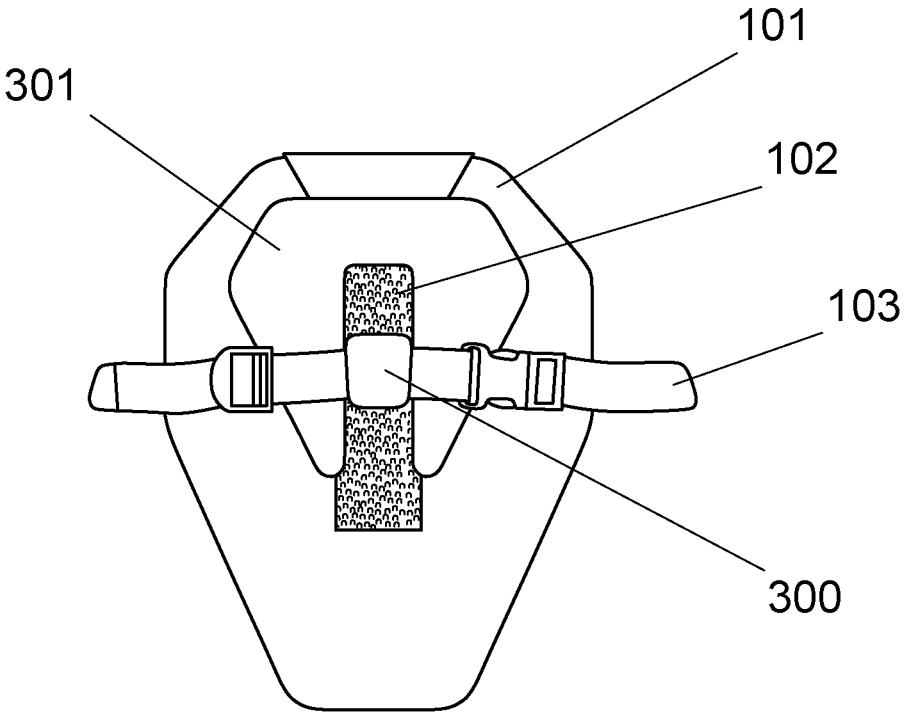
FIG. 6 is a front view of a further embodiment of the abdominal pad, reversibly attached to a belt.

FIG. 6 shows a further embodiment of abdominal pad 101, featuring a vertically oriented adjustment surface 102, covered in part at its edges by fitted cover 301. Waist band 103 features buckles and closures rather than comprising elasticized straps as in the embodiment seen in FIG. 1. In this embodiment, waist band 103 may be manufactured from elasticized fabric as described previously, or may be manufactured from strapping without substantial elasticity, such as strapping made from nylon, woven polyester, or other polymer materials as are typically used in for sporting equipment with buckles and closures as shown herein. Waist band 103 also features attachment pad 300 which incorporates VELCRO on its underside. In this case, if adjustment surface 102 comprises hook VELCRO, attachment pad 300 would incorporate loop VELCRO.

Figure 7:
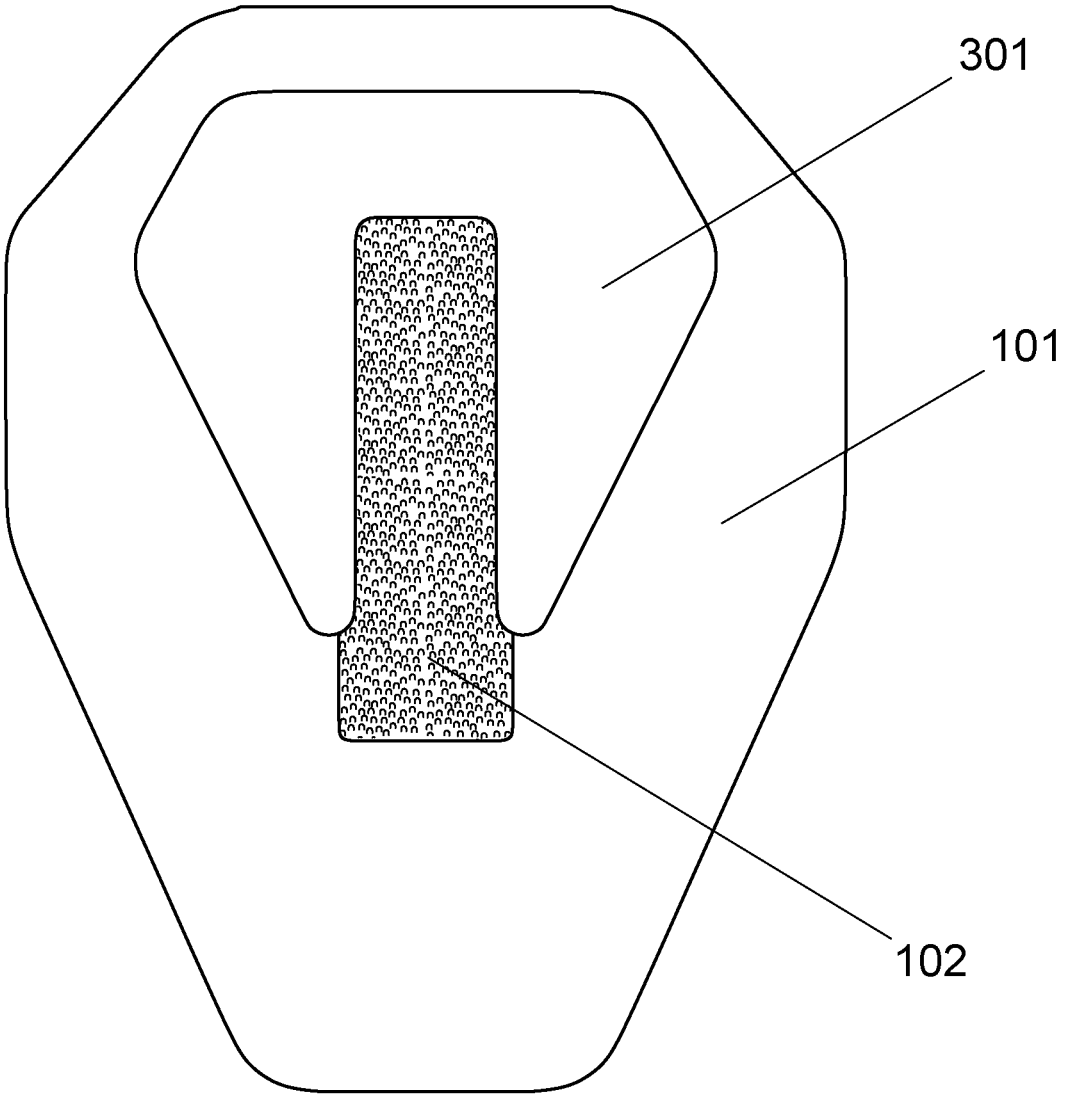
FIG. 7 is a front view of the embodiment of the isolated abdominal pad of FIG. 6.

FIG. 7 shows an isolated view of the embodiment of abdominal pad 101 seen in FIG. 6. Fitted cover 301 serves to cover the edges of VELCRO strip 102 which are most likely to be subject to wear and fray during use.

Figure 8:
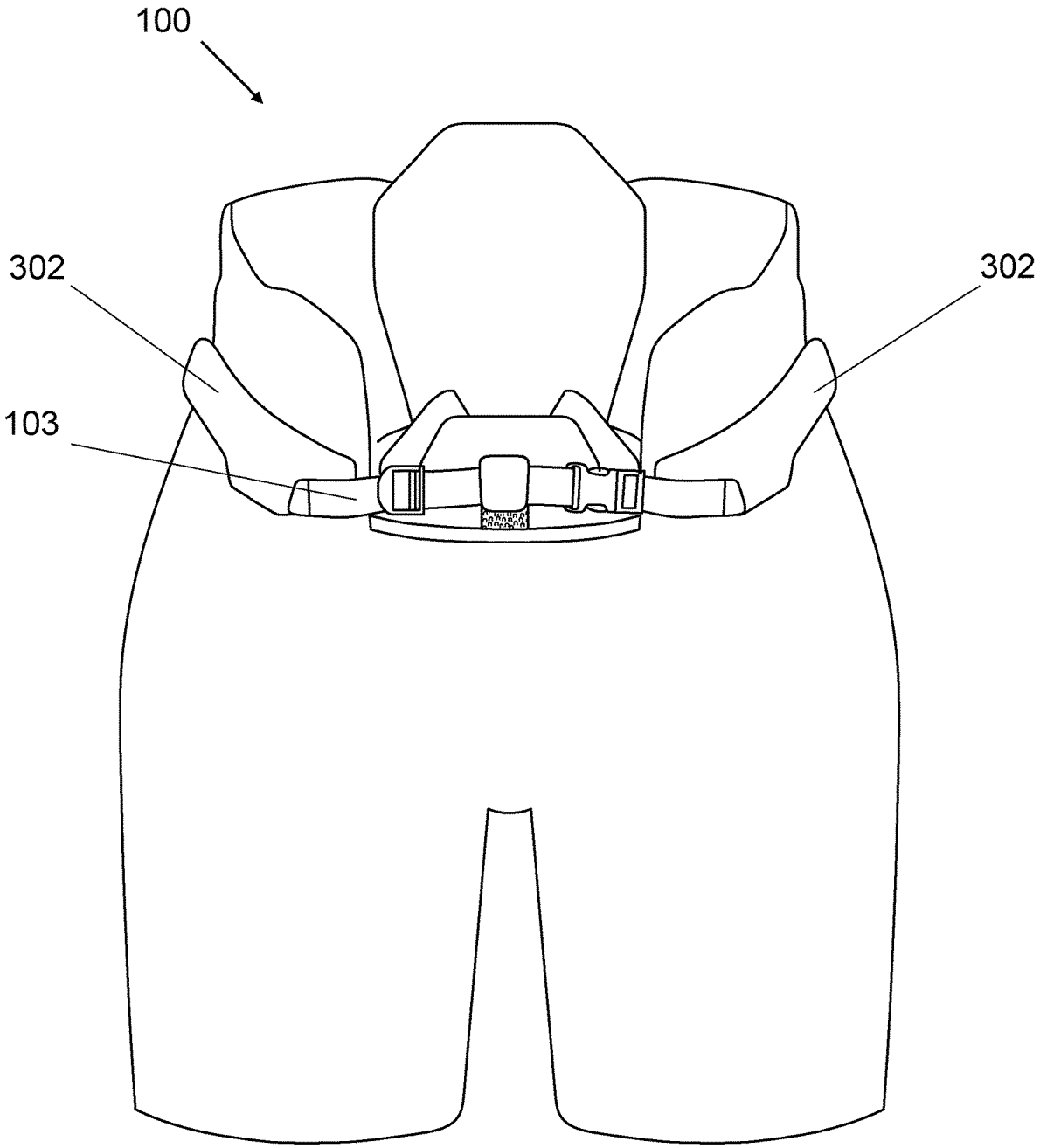
FIG. 8 is a front view of hockey pants including an outer shell and showing the abdominal pad attached in a lower height position along the longitudinal axis of the pants (i.e. the vertical axis extending from the direction of the waist portion to the bottom edge of the pants)
Figure 9:
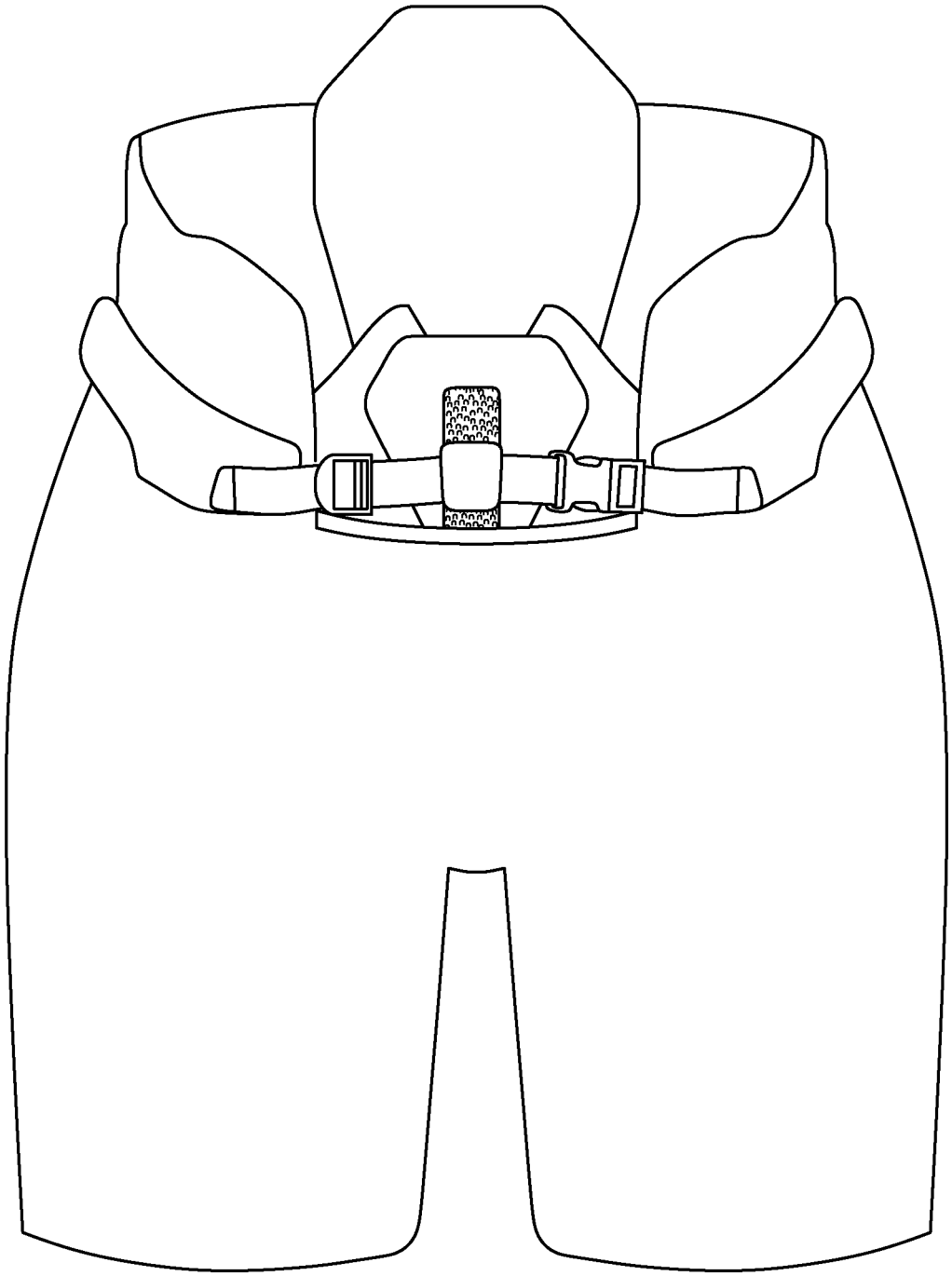
FIG. 9 is a front view of the hockey pants of FIG. 8 showing the abdominal pad attached at a medium height position.
Figure 10:
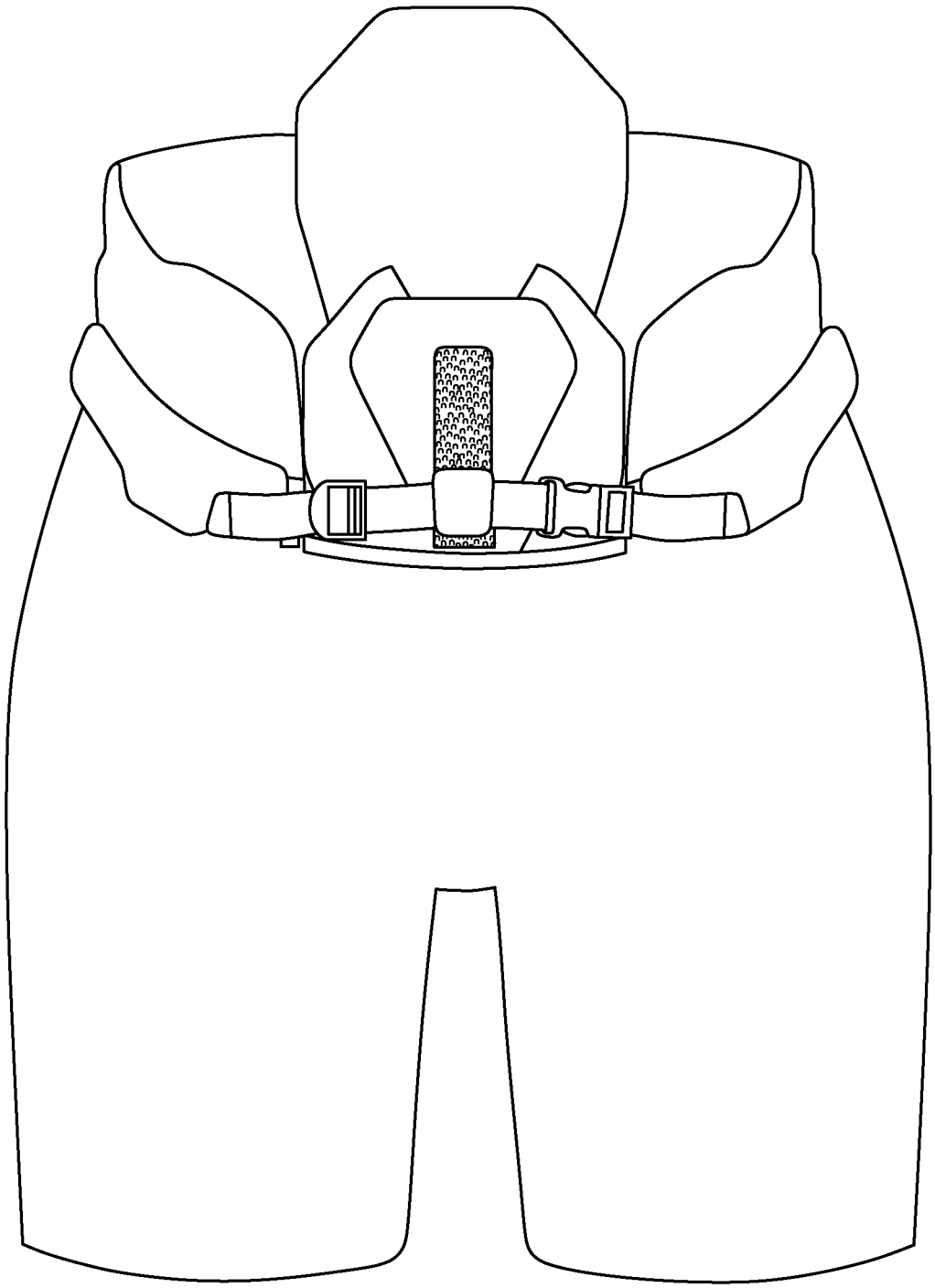
FIG. 10 is a front view of the hockey pants of FIG. 8 showing the abdominal pad attached at a higher height position relative to the positions shown in FIG. 8 and FIG. 9.

FIG. 8, FIG. 9 and FIG. 10 respectively show the abdominal pad 101 of FIG. 6 worn in a low, medium, and high position along the front of the abdominals. The positioning of the abdominal pad 101 may be chosen by the wearer according to his or her preference and comfort. For instance, a high position for abdominal pad 101 as shown in FIG. 10 may be preferred for a player wishing to maximize abdominal protection, such as a pregnant player or a player having abdominal fat. Conversely, a low or medium height position for abdominal pad 101 may be chosen by a player having abdominal fat who prefers to wear the pad lower than the belly, or who will be benched for a significant portion of the game and will therefore be more comfortable with a lower positioned pad. The player has a range of choices for positioning the abdominal pad as fitting to the circumstances of play and body type.

As also shown in the embodiments of FIG. 8, FIG. 9 and FIG. 10, hockey pants 100 may comprise only a single constricting structure which serves to both cinch hockey pants around the waist, and to hold abdominal pad 101 in place. In this embodiment, waist band 103 features buckles and closures as previously described in FIG. 6, but waist band 103 does not itself extend around the entire circumference of the waist. Instead, waist band 103 is attached at its ends to side bands 302, which are located on the outer surface of hockey pants 100, and configured to fall at the natural waist line of the wearer. Side bands 302 may be constructed from elasticized or non-elasticized fabric. Working together with the attached waist band 103, side bands 302 serve to keep hockey pants 100 cinched about the waist. In this embodiment, the upper edges of hockey pants may extend somewhat higher on the body than in the embodiment shown in FIG. 1 and FIG. 2, and provide a protective shell cradling the spine and kidney region. In this embodiment, padding for the spine and kidneys are incorporated into the upper back edge of the pants themselves rather than forming part of waist band 103. As well, when constructing hockey pants 100 in accordance with such an embodiment having a single point of cinching about the waist, it will be useful to use a version of the abdominal pad 101 which has a broader range available for its vertical positioning. This may be achieved by use of the vertically oriented version of the adjustment surface 102 as shown in FIG. 4, FIG. 6 and FIG. 7 as opposed to the horizontally oriented adjustment surface 102 shown in FIG. 3.

Figure 11:
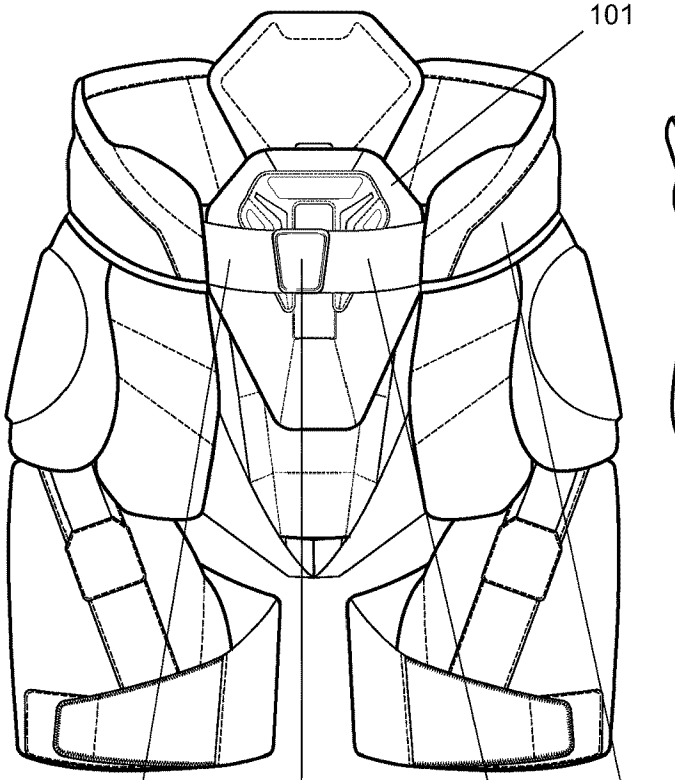
FIG. 11 is a front view of the inner padded layer of an alternate embodiment of the hockey pants of the invention.

FIG. 11 shows a further embodiment of hockey pants 100, in which outer covering 206 has been removed for better visibility. In this embodiment, attachment pad 300 is centered on a waist band 103 consisting of two straps affixed together in front of attachment pad 300. Waist band 103 may also form a single strap extending across to bridge the opposing side bands 302. As long as some provision is made for attachment pad 300 to connect with abdominal pad 101, many configurations are possible for waist band 103.

Figure 13:
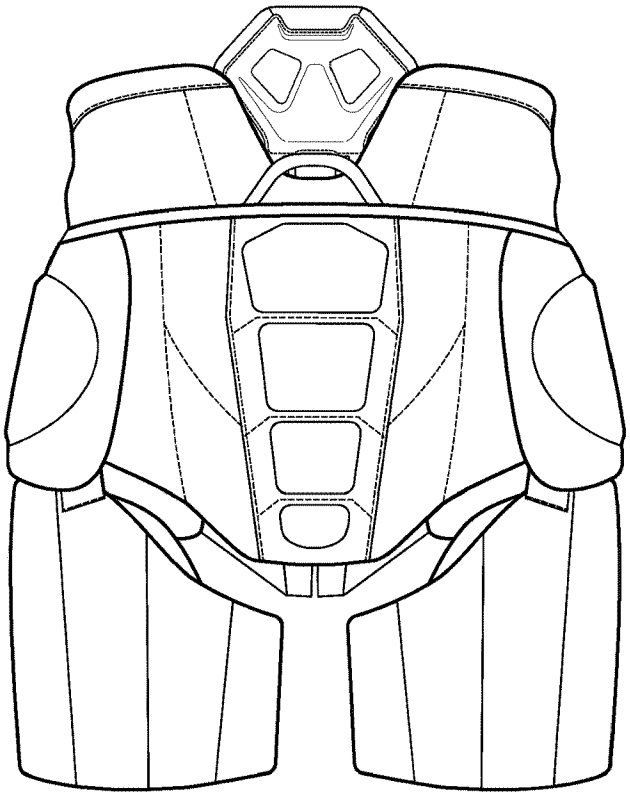
FIG. 13 is a back view of the hockey pants of FIG. 11.
Figure 12:
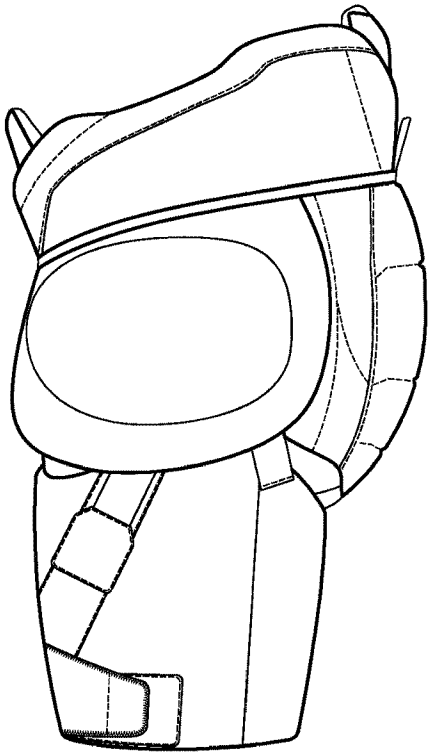
FIG. 12 is a side view of the hockey pants of FIG. 11.
Figure 14:
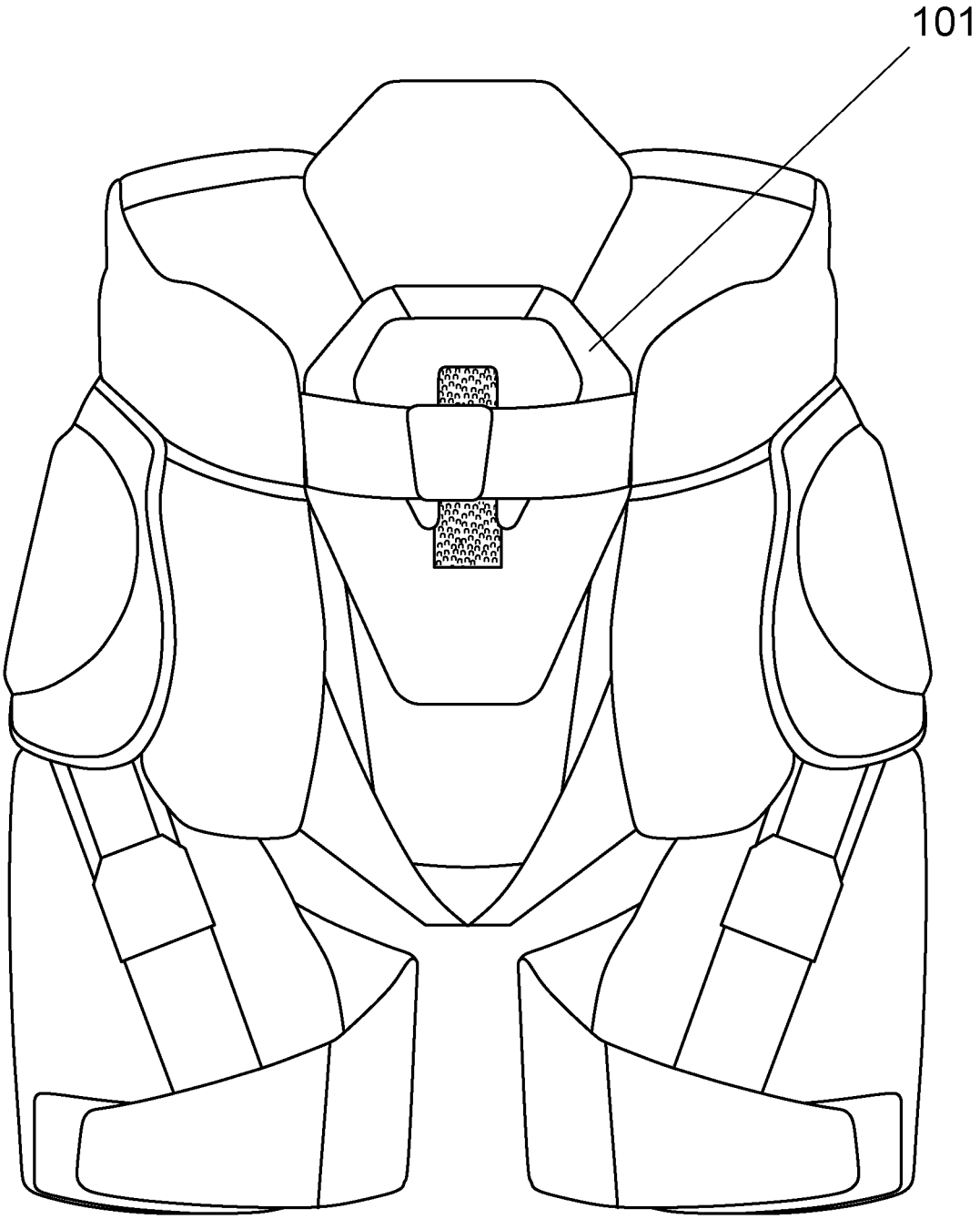
FIG. 14 is a front view of an inner padded layer of an embodiment of the hockey pants of the invention.

FIG. 12 and FIG. 13 respectively provide side and back views of the hockey pants 100 of FIG. 11. FIG. 14 shows a further front view of hockey pants 100, which also illustrates that abdominal pad 101 can also be worn off-center in accordance with the particular needs of a player. For instance, if the player is recovering from an abdominal injury and wishes to selectively cover a portion of the abdominals, there is enough vertical as well as horizontal adjustability to the position of abdominal pad 101 to allow such customization.

What is therefore provided is a versatile design for hockey pants incorporating floating protection for the abdominals. The location of the abdominal protection can be adjusted as described above in accordance with the particular needs and comfort of the player. Because the abdominal protection is indirectly connected to the pants by strapping, rather than forming an extension of the main body of the pants themselves, the abdominal protection is able to more flexibly move with the player and remain unobtrusive even when the player is in bent, crouched, or sitting positions.

While the invention has been described with reference to specific embodiments, it will be appreciated that numerous variations, modifications, and embodiments would be evident to a person of skill in the art.

What is claimed is:

1. A hockey pant assembly for a body of a wearer having a waist area, abdominal area having a vertical axis and a horizontal axis, spine area, two kidney areas, and two thigh areas, said hockey pants comprising:

a main body portion having two legs which cover at least in part said two thigh areas;

a pad for covering said abdominal area at least in part, wherein said pad comprises an adjusting portion for adjusting a position of said pad relative to said wearer's abdominal area in at least one of a vertical direction along said vertical axis and horizontal direction along said horizontal axis; and one or more straps for reversibly connecting said pad to said main body portion.

2. The hockey pant assembly of claim 1 in which at least one of said straps comprises a connecting portion which reversibly connects with said adjusting portion of said pad.

3. The hockey pant assembly of claim 2 in which said adjusting portion of said pad and said connecting portion of said strap respectively comprise opposing VELCRO surfaces.

4. The hockey pant assembly of claim 1 in which said one or more straps comprise elasticized material.

5. The hockey pant assembly of claim 1 in which there is a plurality of straps comprising means for reversibly connecting to each other.

6. The hockey pant assembly of claim 5 wherein the number of straps is two.

7. The hockey pant assembly of claim 5 in which said means for reversibly connecting said straps to each other comprise opposing VELCRO surfaces.

8. The hockey pant assembly of claim 1 in which said straps are connected to said main body to cinch said pant assembly about said waist region of the wearer.

9. The hockey pant assembly of claim 1 in which said straps are connected to bands which are in turn connected to said main body to cinch said pant assembly about said waist region of the wearer.

10. The hockey pant assembly of claim 1 which further comprises padding for the spine area.

11. The hockey pant assembly of claim 1 which further comprises padding for the kidney areas.

12. The hockey pant assembly of claim 1 which further comprises padding for the thigh areas.

13. The hockey pant assembly of claim 1 in which said pad comprises foam padding.

14. The hockey pant assembly of claim 1 which further comprises a belt for cinching said pants about the waist area of said wearer.

15. Use of the hockey pant assembly of claim 1 to protect the abdominal area of the wearer.

* * * * *